US007634099B2

(12) United States Patent
Harvey et al.

(10) Patent No.: US 7,634,099 B2
(45) Date of Patent: Dec. 15, 2009

(54) HIGH-FIDELITY EARPIECE WITH ADJUSTABLE FREQUENCY RESPONSE

(75) Inventors: Jerry J. Harvey, Newport Beach, CA (US); Medford Alan Dyer, San Diego, CA (US)

(73) Assignee: Logitech International, S.A. (CH)

( * ) Notice: Subject to any disclaimer, the term of this patent is extended or adjusted under 35 U.S.C. 154(b) by 819 days.

(21) Appl. No.: 11/285,907

(22) Filed: Nov. 23, 2005

(65) Prior Publication Data

US 2007/0036385 A1 Feb. 15, 2007

Related U.S. Application Data

(60) Provisional application No. 60/701,559, filed on Jul. 22, 2005.

(51) Int. Cl.

| | |
|---|---|
| ***H04R 25/00*** | (2006.01) |
| *H04R 1/00* | (2006.01) |
| *H04R 9/06* | (2006.01) |
| *H04R 11/02* | (2006.01) |

(52) U.S. Cl. ..... 381/380; 381/328; 381/417; 381/418

(58) Field of Classification Search ..... 381/328, 381/418, 380

See application file for complete search history.

(56) References Cited

U.S. PATENT DOCUMENTS

| | | | | | |
|---|---|---|---|---|---|
| 2,390,794 | A | * | 12/1945 | Knight | 381/320 |
| 2,430,229 | A | * | 11/1947 | Kelsey | 381/338 |
| 3,871,372 | A | | 3/1975 | Bivins | |
| 5,068,901 | A | | 11/1991 | Carlson | |
| 5,332,871 | A | | 7/1994 | Carrigan | |
| 5,949,896 | A | | 9/1999 | Nageno et al. | |
| 6,072,885 | A | * | 6/2000 | Stockham et al. | 381/321 |

* cited by examiner

*Primary Examiner*—Brian Ensey
*Assistant Examiner*—Matthew Eason
(74) *Attorney, Agent, or Firm*—Patent Law Office of David G. Beck

(57) ABSTRACT

An earpiece is provided that includes an earpiece enclosure, a sound delivery member that contains a sound delivery tube, and one or more drivers. The earpiece enclosure includes one or more enclosure ports that couple the internal enclosure volume to the volume outside of the earpiece. Corresponding to each enclosure port is a port cover that has at least a fully open port position and a fully closed port position. Preferably the port cover is capable of multiple positions between the fully open port position and the fully closed port position. The port cover can be a plug, a rotating earpiece collar, a sliding cover, etc. In at least one embodiment, separate drivers and/or separate volumes within the earpiece enclosure are coupled to separate enclosure ports.

17 Claims, 7 Drawing Sheets

HIGH-FIDELITY EARPIECE WITH ADJUSTABLE FREQUENCY RESPONSE

CROSS-REFERENCES TO RELATED APPLICATIONS

This application claims the benefit of U.S. Provisional Patent Application Ser. No. 60/701,559, filed Jul. 22, 2005, the disclosure of which is incorporated herein by reference for any and all purposes.

FIELD OF THE INVENTION

The present invention relates generally to audio monitors and, more particularly, to in-ear monitors.

BACKGROUND OF THE INVENTION

Earpieces, also referred to as in-ear monitors and canal phones, are commonly used to listen to both recorded and live music. A typical recorded music application would involve plugging the earpiece into a music player such as a CD player, flash or hard drive based MP3 player, home stereo, or similar device using the earpiece's headphone jack. Alternately, the earpiece can be wirelessly coupled to the music player. In a typical live music application, an on-stage musician wears the earpiece in order to hear his or her own music during a performance. In this case, the earpiece is either plugged into a wireless belt pack receiver or directly connected to an audio distribution device such as a mixer or a headphone amplifier. This type of monitor offers numerous advantages over the use of stage loudspeakers, including improved gain-before-feedback, minimization/elimination of room/stage acoustic effects, cleaner mix through the minimization of stage noise, increased mobility for the musician and the reduction of ambient sounds.

Earpieces are quite small and are normally worn just outside the ear canal. As a result, the acoustic design of the monitor must lend itself to a very compact design utilizing small components. Some monitors are custom fit (i.e., custom molded) while others use a generic "one-size-fits-all" eartip.

Prior art earpieces use either one or more diaphragm-based drivers, one or more armature-based drivers, or a combination of both driver types. Broadly characterized, a diaphragm is a moving-coil speaker with a paper or mylar diaphragm. Since the cost to manufacture diaphragms is relatively low, they are widely used in many common audio products (e.g., ear buds). In contrast to the diaphragm approach, an armature receiver utilizes a piston design. Due to the inherent cost of armature receivers, however, they are typically only found in hearing aids and high-end in-ear monitors.

Armature drivers, also referred to as balanced armatures, were originally developed by the hearing aid industry. This type of driver uses a magnetically balanced shaft or armature within a small, typically rectangular, enclosure. A single armature is capable of accurately reproducing low-frequency audio or high-frequency audio, but incapable of providing high-fidelity performance across all frequencies. To overcome this limitation, armature-based earpieces often use two, or even three, armature drivers. In such multiple armature arrangements, a crossover network is used to divide the frequency spectrum into multiple regions, i.e., low and high or low, medium, and high. Separate armature drivers are then used for each region, individual armature drivers being optimized for each region. In contrast to the multiple driver approach often used with armature drivers, earpieces utilizing diaphragm drivers are typically limited to a single diaphragm due to the size of the diaphragm assembly. Unfortunately, as diaphragm-based monitors have significant frequency roll off above 4 kHz, an earpiece with a single diaphragm cannot achieve the desired upper frequency response while still providing an accurate low frequency response.

In order to obtain the best possible performance from an earpiece, the driver or drivers within the earpiece are tuned. Armature tuning is typically accomplished through the use of acoustic filters (i.e., dampers). Further armature tuning can be achieved by porting, or venting, the armature enclosure as well as the earpiece itself. Diaphragm drivers, due to the use of a moving-coil speaker, are typically tuned by controlling the dimensions of the diaphragm housing. Depending upon the desired frequency response, the diaphragm housing may or may not be ported.

Although there are a variety of techniques used to tune a particular earpiece design, these techniques are implemented during fabrication. As a result, the end user is unable to tune, or otherwise customize, the sound characteristics of the earpiece. Accordingly, what is needed in the art is an earpiece that can be tuned, at least to a limited degree, by the end user. The present invention provides such an earpiece.

SUMMARY OF THE INVENTION

The present invention provides an earpiece for use with either a recorded or a live audio source. The disclosed earpiece includes an earpiece enclosure and a sound delivery member that contains a sound delivery tube. Within the earpiece enclosure is a driver, although the invention can also be used with an earpiece enclosure containing two or more drivers. Armature drivers, diaphragm drivers, or a combination of the two driver types can be contained within the earpiece enclosure. In at least one embodiment, acoustic dampers are interposed between the one or more driver outputs and the eartip. The earpiece enclosure includes one or more enclosure ports that couple the internal enclosure volume to the volume outside of the earpiece. Corresponding to each enclosure port is a port cover that has at least a fully open port position and a fully closed port position. Preferably the port covering means is capable of multiple positions between the fully open port position and the fully closed port position. The port cover can be a plug, a rotating earpiece collar, a sliding cover, or other means. In at least one embodiment, separate drivers and/or separate volumes within the earpiece enclosure are coupled to separate enclosure ports.

A further understanding of the nature and advantages of the present invention may be realized by reference to the remaining portions of the specification and the drawings.

DESCRIPTION OF THE SPECIFIC EMBODIMENTS

Figure 1:
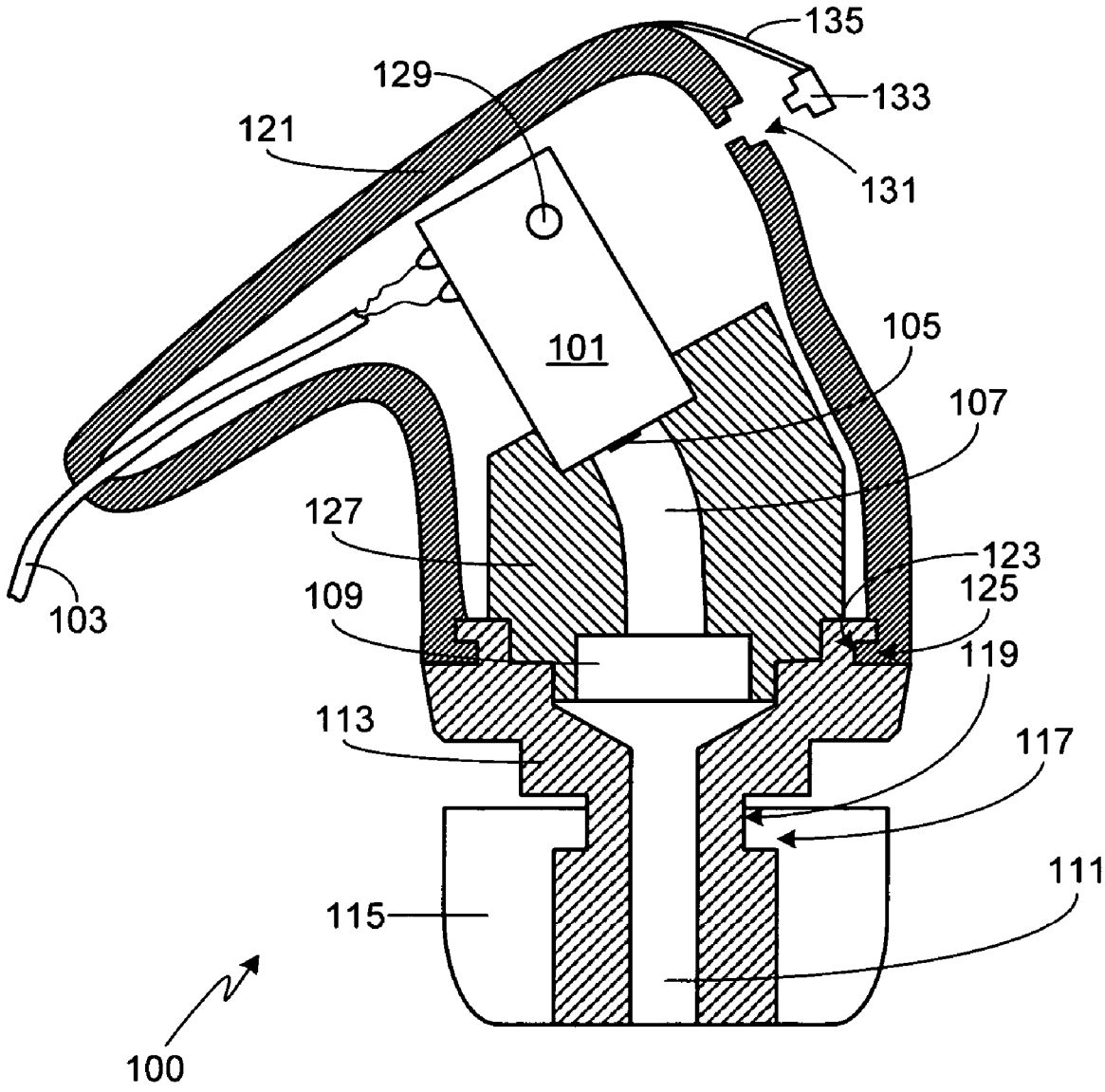
FIG. 1 illustrates an embodiment of the invention utilizing a single armature driver and a single port/port plug arrangement.

FIG. 1 is an illustration of one embodiment of the invention. Earpiece 100, also referred to herein as an in-ear monitor and a canalphone, includes a single armature driver 101. As described further below, the present invention is not limited to earpieces that utilize a single driver. Additionally, although the figures indicate armature drivers, it should be understood that the invention is also applicable to other driver types (e.g., diaphragm drivers) or combinations of different driver types (e.g., armature and diaphragm combinations).

In this embodiment, the signal from the source (not shown) is coupled to earpiece 100, and more specifically driver 101, via cable 103. The invention is not limited to a particular source, exemplary sources including audio receivers, mixers, music players, headphone amplifiers, etc. Only a portion of cable 103 is visible in FIG. 1. The sound that is produced by armature driver 101 exits an output port 105 and passes through a sound delivery tube 107. Preferably the output end of sound tube 107 is coupled to a damper 109, also commonly referred to as an acoustic filter. In addition to providing a means of tuning the frequency response of the earpiece, for example by reducing the output level for a particular frequency range, damper 109 can also be used to reduce the overall sound pressure level. The sound passing through damper 109, or directly from sound tube 107, enters sound delivery tube 111 of sound delivery member 113. At least a portion of sound delivery member 113 is designed to fit within the outer ear canal of the user and as such, is generally cylindrical in shape.

Attached to the end portion of sound delivery member 113 is an eartip 115, also referred to as an eartip sleeve or simply a sleeve. Without departing from the invention, eartip 115 or the combination of sound delivery member 113 and eartip 115 can be replaced with a custom fit eartip (not shown). A custom fit eartip is one that is designed to fit into a particular user's ear. Custom fit eartips, which are left ear and right ear specific, are made by first making a casting of the user's ear canal and concha, and then molding the earpiece from the casting.

Custom fit earpieces typically provide better performance, both in terms of delivered sound fidelity and user comfort, than generic earpieces. Generic earpieces, however, are generally much less expensive as custom molds are not required and the earpieces can be manufactured in volume. In addition to the cost factor, generic earpieces are typically more readily accepted by the general population since many people find it both too time consuming and somewhat unnerving to have to go to a specialist, such as an audiologist, to be fitted for a custom earpiece.

In the illustrated embodiment, a generic eartip 115 is shown. Eartip 115 can be fabricated from any of a variety of materials including foam, plastic and silicon based material. Sleeve 115 can have the generally cylindrical and smooth shape shown in FIG. 1, or can include one or more flanges. To hold sleeve 115 onto member 113 during normal use but still allow the sleeve to be replaced when desired, typically the eartip includes a lip portion 117 which is fit into a corresponding channel or groove 119 in sound delivery member 113. The combination of an interlocking groove 119 with a lip 117 provides a convenient means of replacing eartip 115, allowing sleeves of various sizes, colors, materials, material characteristics (density, compressibility), or shape to be easily attached to in-ear monitor 100. As a result, it is easy to provide the end user with a comfortable fit at a fraction of the cost of a custom fit eartip. Additionally, the use of interlocking members 117 and 119 allow worn out eartips to be quickly and easily replaced. It will be appreciated that other eartip mounting methods can be used with earpiece 100 without departing from the invention. For example, eartip 115 can be attached to sound delivery member 113 using pressure fittings, bonding, etc.

An outer earpiece enclosure 121 attaches to sound delivery member 113. Earpiece enclosure 121 protects driver 101 (or multiple drivers) and any required earpiece circuitry (e.g., cross-over circuit for multiple driver implementation) from damage while providing a convenient means of securing cable 103, or alternately a cable socket (not shown), to the in-ear monitor. Enclosure 121 can be attached to member 113 using interlocking members (e.g., groove 123, lip 125). Alternately, an adhesive or other means can be used to attach enclosure 121 to member 113. Enclosure 121 can be fabricated from any of a variety of materials, thus allowing the designer and/or user to select the material's firmness (i.e., hard to soft), texture, color, etc. Enclosure 121 can either be custom molded or designed with a generic shape.

There are a variety of techniques that can be used to hold, or mount, the components of the earpiece within earpiece enclosure 121. In the preferred embodiment, a boot member 127 is used to hold damper 109, sound tube 107 and a portion of driver 101 in place. It will be understood that the invention is not limited to this particular boot arrangement, for example boot member 127 can be extended to capture a greater portion of the driver 101.

Driver 101 includes a port, or vent, 129. According to the invention, earpiece enclosure 121 includes a port 131 and a matching plug 133. Although not required, plug 133 can be attached to earpiece 100, for example using a flexible member 135, thus preventing plug loss. It will be appreciated that plug 133 can be replaced with other port covering means, some of which are described in further detail below.

When port 131 is unplugged, as shown, driver 101 is ported to outside of earpiece 100. In contrast, when port 131 is plugged with port plug 133, driver 101 is ported only to the closed internal volume of earpiece 100. As a result of this porting flexibility, the user is able to adjust the frequency response of the earpiece, in particular extending the base response of the earpiece by simply uncovering or unplugging port 131. Thus the user is able to tailor, to a limited degree, the earpiece for particular music (e.g., acoustic versus heavy metal, rock versus classical, etc.) or for a particular listening mode or behavior. The variable porting capability of the invention can also be used to tailor, to a limited degree, the ambient sound blockage capabilities of the earpiece. Specifically, by unblocking port 131 earpiece 100 allows more ambient sounds and/or noise to reach the user. This capability can be used by the end user to alter the earpiece as the environment changes (e.g., user going from a quiet environment to a noisy environment), or as the user's needs change (e.g., off-stage usage versus on-stage usage).

Figure 2:
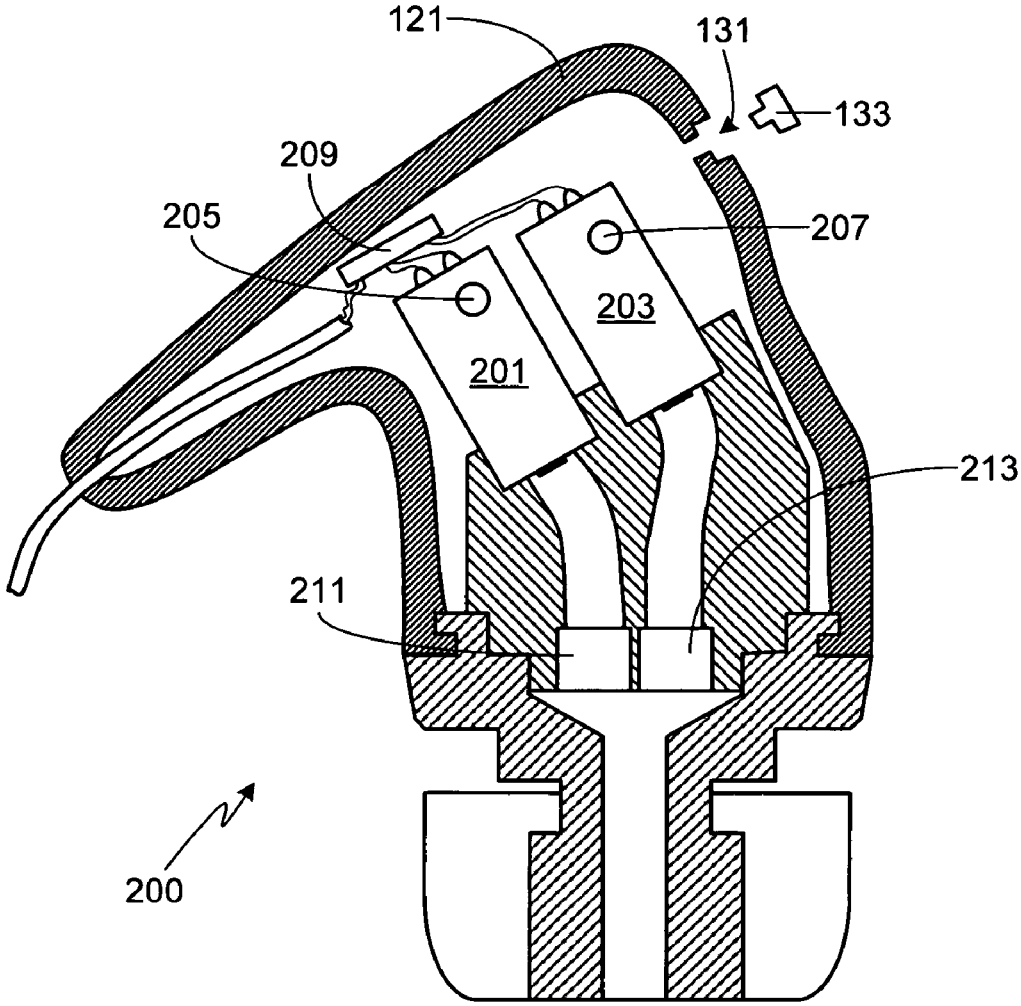
FIG. 2 illustrates an embodiment of the invention utilizing a pair of armature drivers and a single port/port plug arrangement.

As previously noted, the invention is not limited to a single driver. For example, FIG. 2 illustrates an embodiment in which earpiece 200 includes a pair of drivers 201/203. Drivers 201/203 include ports 205/207, respectively. Although not critical to the invention, FIG. 2 also shows a circuit 209, preferably comprised of a passive crossover circuit. The passive crossover circuit divides the incoming audio signal into a low-frequency portion electrically routed to driver 201 and a high-frequency portion electrically routed to driver 203. Preferably each driver includes an individual damper (i.e., 211/213).

In the embodiment illustrated in FIG. 2, plugging or unplugging port 131 affects the frequency response of both drivers 201/203 as both drivers are individually ported (i.e., ports 205/207). If desired, only one of the drivers can be ported, thus limiting the effects of port 131 to the ported driver. This approach can be used, for example, to alter only the frequency response of the driver being used to drive the lower frequencies, thus providing an effective means of further increasing the base response of the earpiece.

Figure 3:
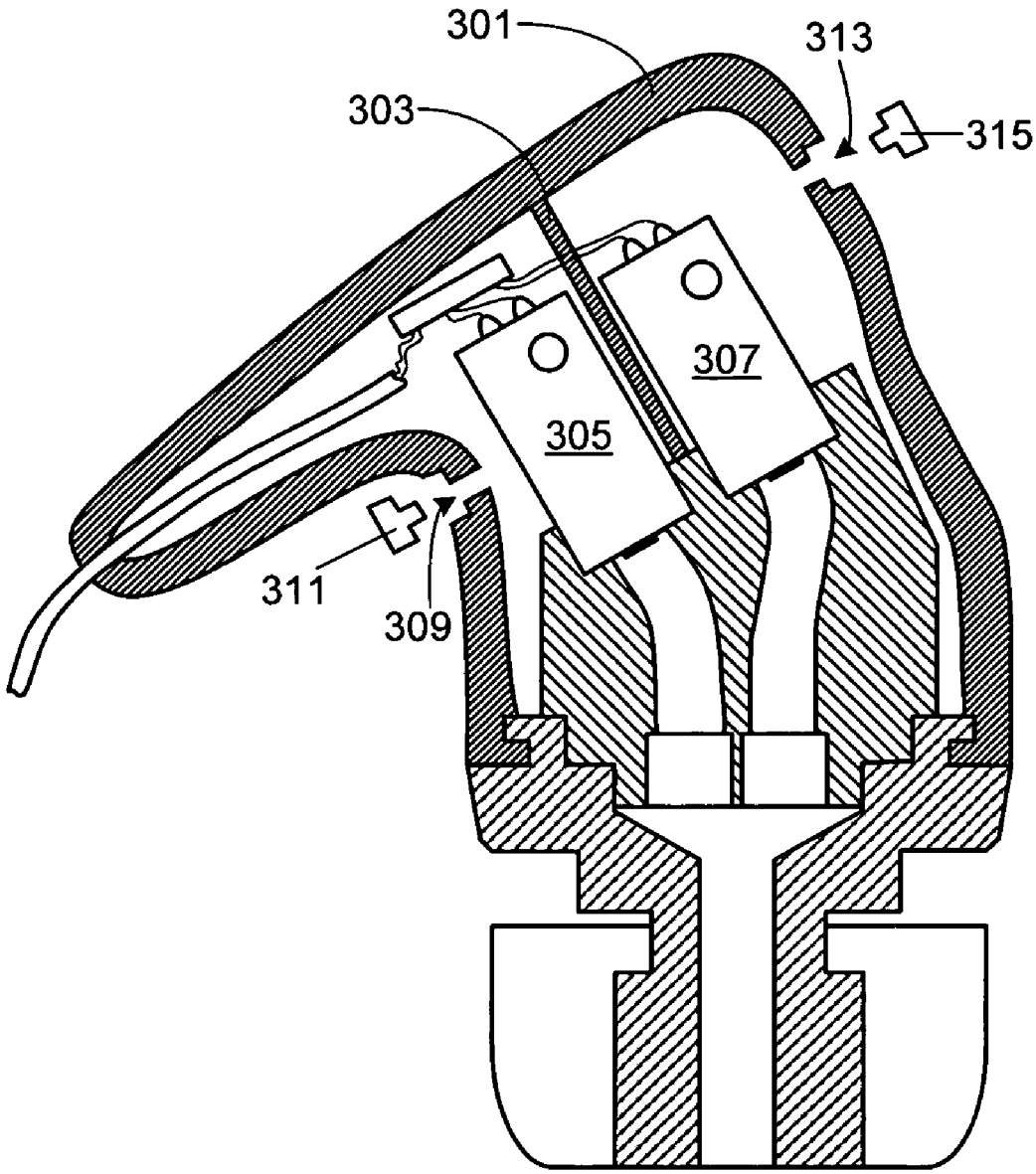
FIG. 3 illustrates an embodiment of the invention utilizing a pair of armature drivers and dual port/port plug arrangements.

In order to provide further control over the frequency characteristics of a multi-driver earpiece, the earpiece enclosure can include separate port/plug assemblies for each ported driver, for example as illustrated in FIG. 3. In the illustrated embodiment, earpiece enclosure 301 includes an internal member 303 that separates the interior volume of the enclosure into two portions, each portion housing a driver (i.e., drivers 305/307). The frequency response of driver 305 is varied by a first port/plug assembly (i.e., port 309 and plug 311) while the frequency response of driver 307 is varied by a second port/plug assembly (i.e., port 313 and plug 315).

Figure 4:
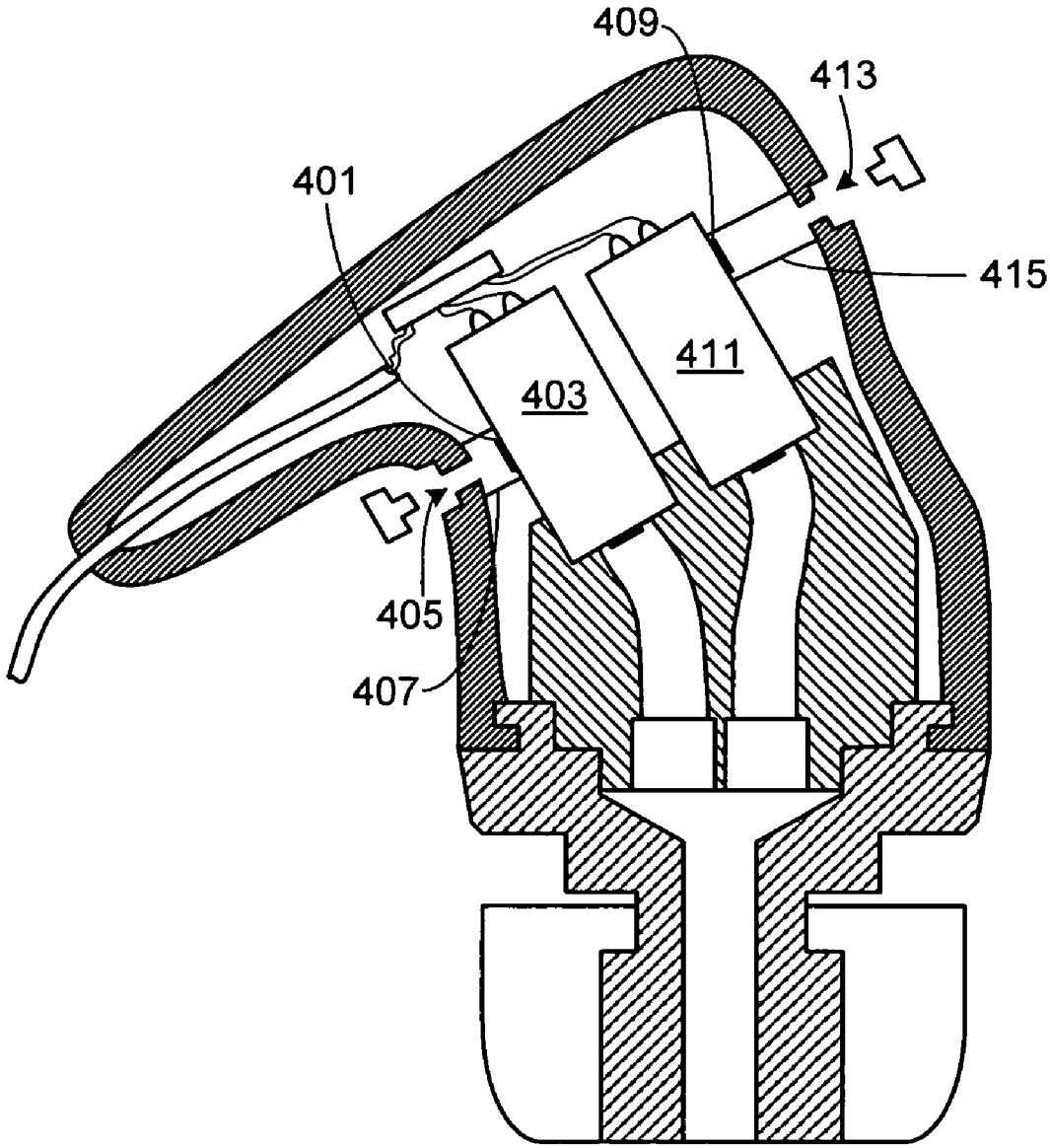
FIG. 4 illustrates an embodiment of the invention similar to that of FIG. 3, except for the means used to couple the driver ports to the enclosure ports.

It will be appreciated that other means can be used to couple individual ports to individual drivers, thereby providing greater control over the frequency response characteristics of the earpiece. For example, in the embodiment illustrated in FIG. 4 the port for each driver is acoustically coupled to an individual earpiece enclosure port. More specifically, port 401 of driver 403 is coupled to earpiece port 405 via vent tube 407 while port 409 of driver 411 is coupled to earpiece port 413 via vent tube 415.

Figure 5:
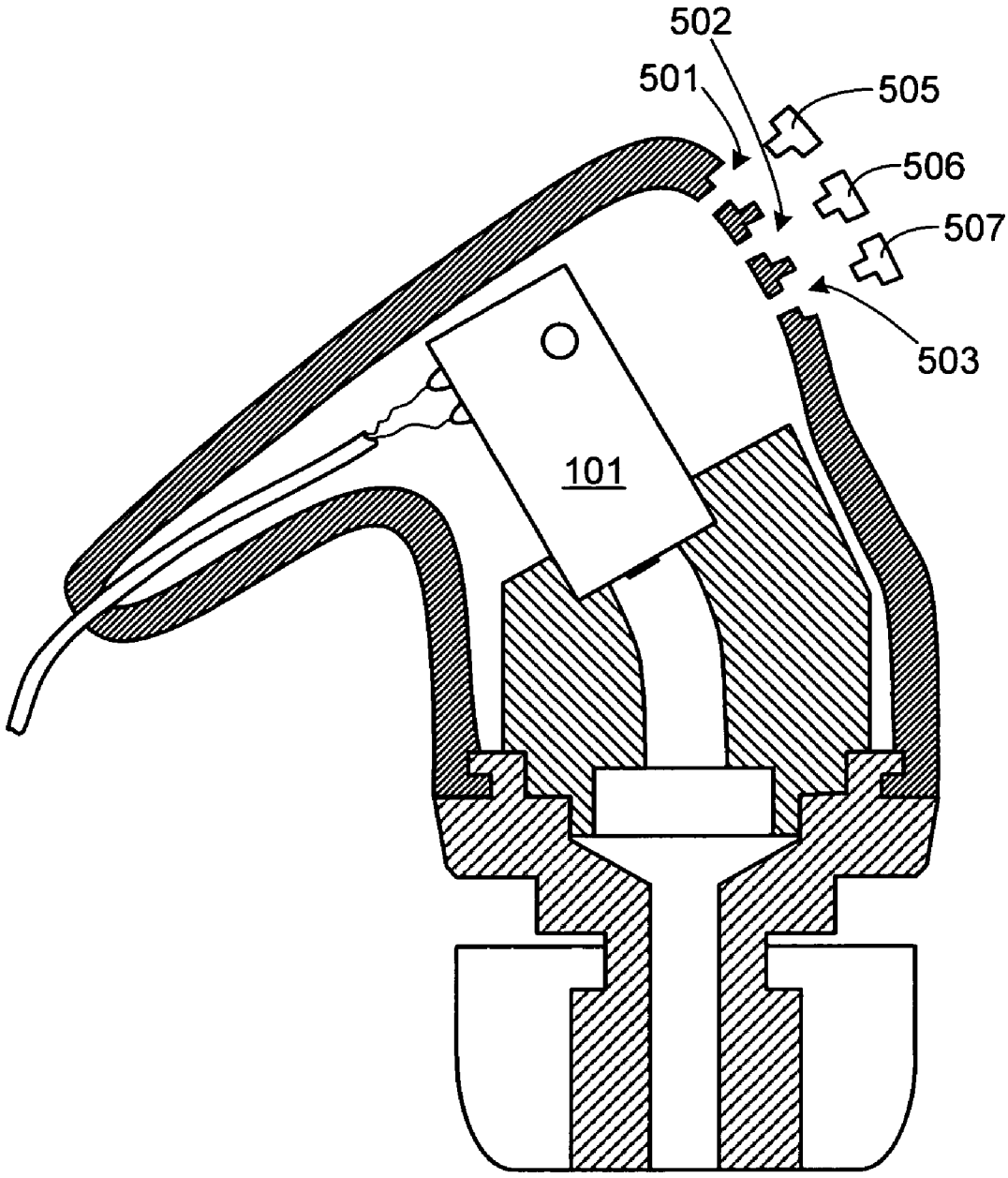
FIG. 5 illustrates an embodiment of the invention similar to that of FIG. 1, except that the earpiece includes multiple port/plug assemblies.

If desired, the amount of available enclosure porting can be varied, thus providing the user with additional frequency response control for the earpiece. For example, FIG. 5 illustrates an embodiment of the invention similar to that of FIG. 1, except for the inclusion of multiple ports 501-503 and corresponding plugs 505-507. As a consequence of this design, the user can open between one and three earpiece ports, or even leave all three of the ports closed.

Figure 6:
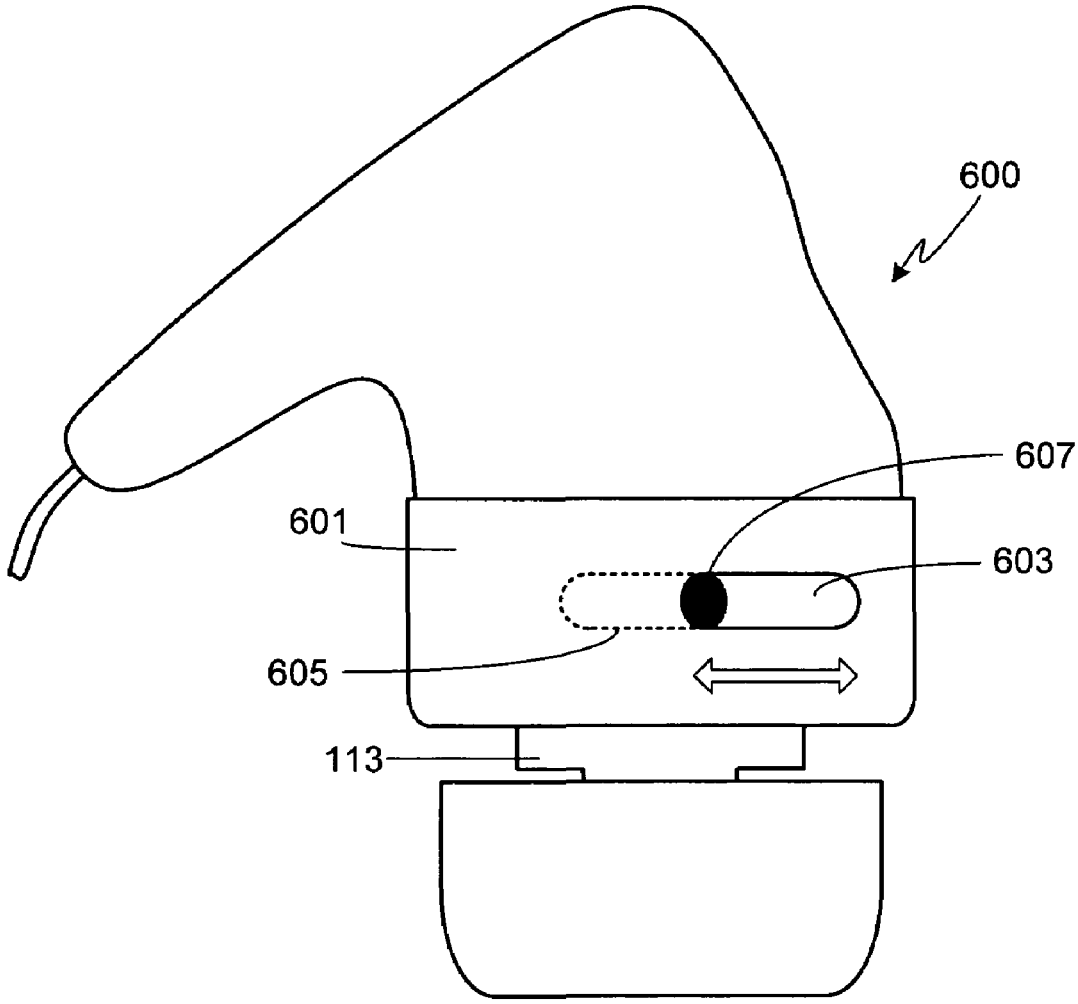
FIG. 6 illustrates an embodiment of the invention similar to that of FIG. 1, except that a rotating earpiece collar controls the degree to which the enclosure port is opened.

A similar effect to that of FIG. 5 can be accomplished with a single, variable port such as that shown in FIG. 6. FIG. 6 is an external view of an earpiece similar to that shown in FIG. 1. Surrounding a portion of earpiece 600 is a collar 601 that can be rotated about the sound delivery member 113. Within collar 601 is an opening 603. Underneath collar 601 is a port 605, shown in phantom, which provides an opening to the earpiece enclosure and to the volume in which the driver or drivers within the earpiece are vented. In the illustrated embodiment both collar opening 603 and port 605 are slot-shaped thus providing a wide range of available port openings. As shown in the figure, collar opening 603 and port 605 overlap slightly, thus porting the interior volume of the earpiece via aligned port/opening region 607. Preferably collar 601 and underlying sound delivery member 113 include means, such as a series of bumps and corresponding depressions, for holding collar 601 in place, thereby preventing accidental changes to the port setting selected by the user. It will be appreciated that other means can be used to achieve the variable port opening provided by rotating collar 601, for example a sliding port cover.

Figure 7:
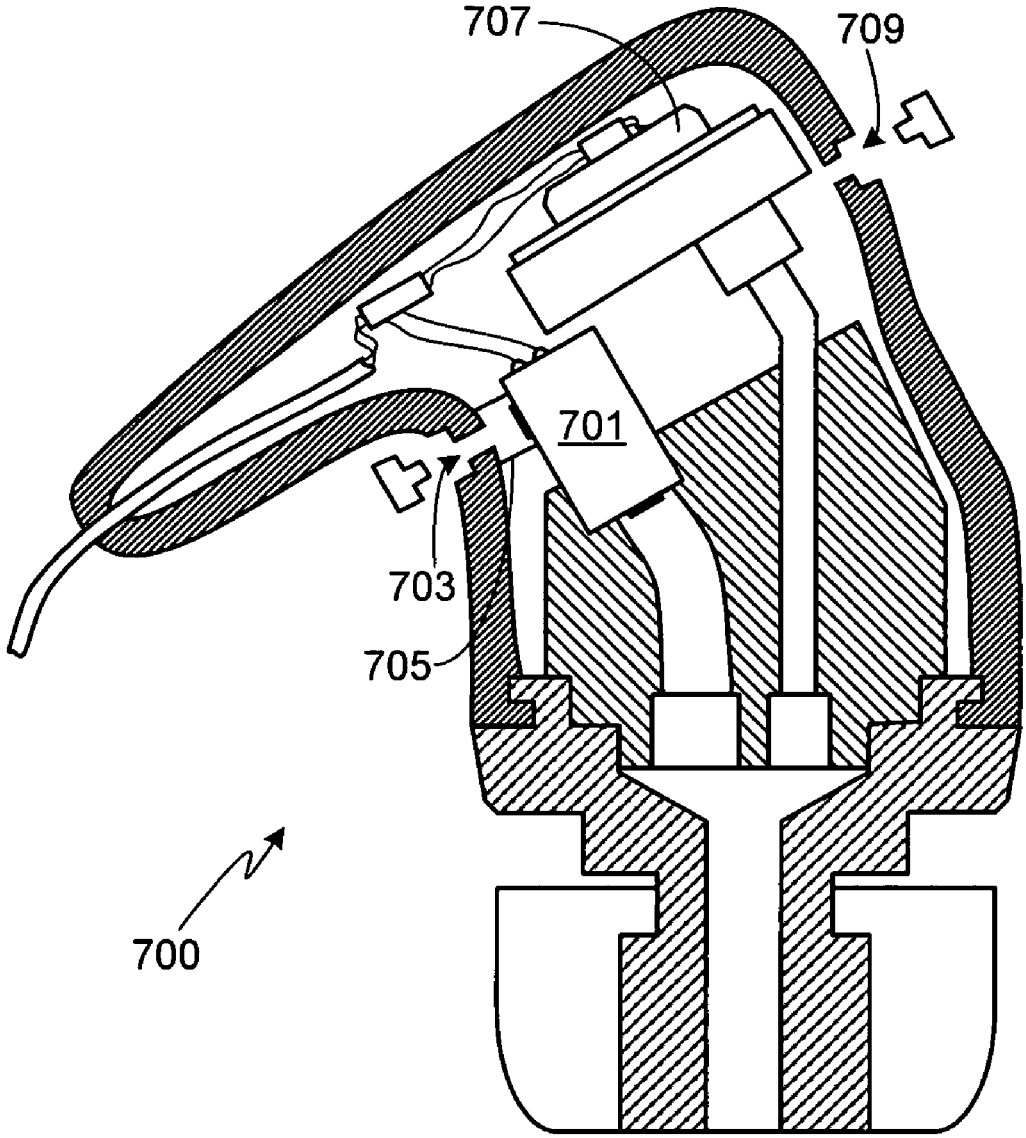
FIG. 7 illustrates an embodiment of the invention utilizing an individually ported armature driver and an individually ported diaphragm driver.

As previously noted, the present invention of including one or more earpiece ports, or a variable earpiece port, is not limited to the number or type of driver within the earpiece. For example, FIG. 7 illustrates an earpiece 700 with a vented driver 701 coupled to earpiece port 703 via vent tube 705, and a diaphragm driver 707 which can be ported to outside the earpiece via port 709. Accordingly those familiar with the art will understand that the present invention may be embodied in other specific forms without departing from the spirit or essential characteristics thereof. As such, the disclosures and descriptions herein are intended to be illustrative, but not limiting, of the scope of the invention which is set forth in the following claims.

What is claimed is:

1. An earpiece comprising:

a sound delivery member, said sound delivery member further comprising a sound delivery tube;

an armature driver, said armature driver further comprising an output port, said driver output port acoustically coupled to said sound delivery tube within said sound delivery member, said armature driver further comprising a second port;

an earpiece enclosure, wherein said earpiece enclosure encloses at least a portion of said armature driver, wherein said second port of said armature driver vents said armature driver to an internal volume of said earpiece enclosure;

an earpiece enclosure port; and means for controllably covering said earpiece enclosure port, said means having at least a first position and a second position, wherein said means in said first position covers said earpiece enclosure port and said means in said second position uncovers said earpiece enclosure port.

2. An earpiece comprising:

a sound delivery member, said sound delivery member further comprising a sound delivery tube;

an armature driver, said armature driver further comprising an output port, said driver output port acoustically coupled to said sound delivery tube within said sound delivery member, said armature driver further comprising a second port;

an earpiece enclosure, wherein said earpiece enclosure encloses at least a portion of said armature driver;

an earpiece enclosure port, wherein said earpiece further comprises a vent tube coupling said armature driver second port to said earpiece enclosure port; and means for controllably covering said earpiece enclosure port, said means having at least a first position and a second position, wherein said means in said first position covers said earpiece enclosure port and said means in second position uncovers said earpiece enclosure port.

3. The earpiece of claim 2, further comprising a second driver.

4. An earpiece comprising:

a sound delivery member, said sound delivery member further comprising a sound delivery tube;

a first driver, said first driver further comprising a first driver output port, said first driver output port acoustically coupled to said sound delivery tube within said sound delivery member;

a second driver;

an earpiece enclosure, wherein said earpiece enclosure further comprises a separating member, wherein said separating member separates an internal earpiece enclosure volume into a first volume and a second volume, wherein at least a portion of said first driver is within said first volume and at least a portion of said second driver is within said second volume;

an earpiece enclosure port, wherein said earpiece enclosure port corresponds to said first volume;

a second earpiece port corresponding to said second volume;

means for controllably covering said earpiece enclosure port, said means having at least a first position and a second position, wherein said means in said first position covers said earpiece enclosure port and said means in said second position uncovers said earpiece enclosure port; and means for controllably covering said earpiece enclosure port.

5. The earpiece of claim 4, wherein said first driver is an armature driver and said second driver is a diaphragm driver.

6. The earpiece of claim 4, wherein said first driver vents to said first volume and said second driver vents to said second volume.

7. An earpiece comprising:

a sound delivery member, said sound delivery member further comprising a sound delivery tube;

an armature driver, said armature driver further comprising an output port, said armature driver output port acoustically coupled to said sound delivery tube within said sound delivery member, said armature driver further comprising a second port, an earpiece enclosure, wherein said earpiece enclosure encloses at least a portion of said armature driver;

an earpiece enclosure port;

a first vent tube coupling said armature driver second port to said earpiece enclosure port;

a second driver, a second earpiece enclosure port;

a second vent tube coupled to said second earpiece enclosure port, wherein said second driver further comprises a third output port acoustically coupled to said sound delivery tube and a fourth port coupled to said second vent tube; and means for controllably covering said earpiece enclosure port, said means having at least a first position and a second position, wherein said means in said first position covers said earpiece enclosure port and said means in second position uncovers said earpiece enclosure port.

8. The earpiece of claim 1, further comprising a second driver and a third driver.

9. The earpiece of claim 1, wherein said covering means is a plug.

10. The earpiece of claim 9, said earpiece further comprising a flexible member coupling said plug to said earpiece.

11. The earpiece of claim 1, said earpiece further comprising a second earpiece enclosure port.

12. The earpiece of claim 11, said earpiece further comprising means for controllably covering said second earpiece enclosure port.

13. The earpiece of claim 1, wherein said covering means further comprises multiple positions between said first position and said second position, wherein said first position, said second position and said multiple positions provide a range of openings for said earpiece enclosure port.

14. The earpiece of claim 1, wherein said covering means further comprises a rotating earpiece collar.

15. The earpiece of claim 1, wherein said covering means further comprises a sliding member.

16. The earpiece of claim 1, further comprising a damper interposed between said driver output port and said sound delivery tube within said sound delivery member.

17. The earpiece of claim 1, further comprising an eartip coupled to said sound delivery member.

* * * * *